US010582770B2

(12) United States Patent
Yang et al.

(10) Patent No.: US 10,582,770 B2
(45) Date of Patent: Mar. 10, 2020

(54) BATHROOM BASE CABINET UNIT HAVING DRYING FUNCTION AND FOOT HOLDING FUNCTION

(71) Applicant: LG ELECTRONICS INC., Seoul (KR)

(72) Inventors: Inhyung Yang, Seoul (KR); Daeyun Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 258 days.

(21) Appl. No.: 15/699,199

(22) Filed: Sep. 8, 2017

(65) Prior Publication Data

US 2018/0070722 A1 Mar. 15, 2018

(30) Foreign Application Priority Data

Sep. 13, 2016 (KR) ..... 10-2016-0118272

(51) Int. Cl.

| | |
|---|---|
| ***A47B 83/00*** | (2006.01) |
| ***A47K 10/48*** | (2006.01) |
| ***E03C 1/32*** | (2006.01) |
| ***F26B 21/00*** | (2006.01) |
| *A47B 88/457* | (2017.01) |

(52) U.S. Cl.

CPC ..... *A47B 83/00* (2013.01); *A47K 10/48* (2013.01); *E03C 1/32* (2013.01); *F26B 21/001* (2013.01); *A47B 88/457* (2017.01); *A47B 2210/16* (2013.01); *A47B 2220/03* (2013.01); *A47B 2220/05* (2013.01)

(58) Field of Classification Search

None

See application file for complete search history.

(56) References Cited

U.S. PATENT DOCUMENTS

| | | | | | |
|---|---|---|---|---|---|
| 2,175,329 | A | * | 10/1939 | Watt | E03C 1/044 4/630 |
| 2,495,374 | A | * | 1/1950 | Horn | A47B 79/00 4/476 |
| 2,587,731 | A | * | 3/1952 | Irving | A47C 7/725 219/217 |
| 2,728,841 | A | * | 12/1955 | Whitlock | A61F 7/02 219/217 |
| 2,731,318 | A | * | 1/1956 | Hoff | A47B 67/005 312/210 |

(Continued)

FOREIGN PATENT DOCUMENTS

| | | |
|---|---|---|
| CN | 1718144 | 1/2006 |
| CN | 201203261 | 3/2009 |

(Continued)

OTHER PUBLICATIONS

Chinese Office Action dated Oct. 21, 2019 issued in Application No. 201710817118.7 (with English Translation).

*Primary Examiner* — Thor S Campbell

(74) *Attorney, Agent, or Firm* — KED & Associates LLP

(57) ABSTRACT

A bathroom base cabinet may include a blower device and a footstool for a drying function and a foot holding function. The bathroom base cabinet may perform a function of drying a bathroom floor by blowing wind in a direction of a floor surface of the bathroom, and a function of drying the body of a user by blowing wind in a direction of an upper surface of the footstool.

19 Claims, 11 Drawing Sheets

(56) References Cited

U.S. PATENT DOCUMENTS 3,481,429 A * 12/1969 Gaede ..... E06C 1/005 182/88
4,195,416 A * 4/1980 Hall ..... A47K 10/48 34/233
4,258,248 A * 3/1981 Campo ..... F24H 3/0405 219/213
4,682,424 A * 7/1987 Irving ..... D06F 58/10 211/123
4,742,429 A * 5/1988 Arrendiell ..... A47K 17/00 200/61.62
5,007,182 A * 4/1991 Fishman ..... A47K 10/48 34/202
5,157,850 A * 10/1992 Terng-Shuh ..... F26B 9/003 34/202
5,454,060 A * 9/1995 McDermott ..... A47K 10/48 34/202
5,475,933 A * 12/1995 Ueda ..... A47K 10/48 177/245
5,491,908 A * 2/1996 Ruiz ..... A47K 10/48 34/202
5,613,304 A * 3/1997 Lin ..... A47K 10/48 177/245
5,617,646 A * 4/1997 Viscuso ..... A47L 23/205 34/233
5,735,586 A * 4/1998 Cheng ..... A47B 46/00 182/35
5,826,347 A * 10/1998 Olivares-Gonzalez de Serrano ..... A47K 10/48 34/202
5,930,912 A * 8/1999 Carder ..... A47K 10/48 34/202
6,393,717 B1 * 5/2002 Santos ..... A47K 10/48 34/231
6,580,060 B1 * 6/2003 Inman ..... B60N 2/5635 219/217
6,705,023 B1 * 3/2004 Hoover ..... A47K 10/48 34/90
6,839,982 B1 * 1/2005 Hoover ..... A61M 11/00 34/104
7,117,611 B2 * 10/2006 Park ..... A47K 10/48 34/90
D535,368 S * 1/2007 Nelson ..... D23/286
7,509,755 B2 * 3/2009 Avanzini ..... A47K 10/48 34/232
D594,258 S * 6/2009 Zuniga ..... D6/702
7,621,599 B2 * 11/2009 Whalen ..... A47C 7/50 297/423.21
7,913,419 B2 * 3/2011 Tomasi ..... D06F 29/00 211/85.3
8,065,814 B2 * 11/2011 Olvera ..... A47K 10/48 34/218
8,141,680 B2 * 3/2012 Wigutoff ..... E04G 1/28 182/223
8,870,307 B1 * 10/2014 Provenzano ..... A45D 44/02 312/209
D731,037 S * 6/2015 Ouyang ..... D23/286
10,316,584 B1 * 6/2019 Cooper ..... E06C 1/005
2006/0284526 A1 * 12/2006 Pathmanathan ..... A47B 46/00 312/228.1
2008/0264723 A1 * 10/2008 Tatum ..... A47C 12/00 182/35
2009/0022485 A1 * 1/2009 Madden ..... A47K 10/48 392/380
2010/0193709 A1 * 8/2010 Dalton ..... A61L 2/10 250/504 R
2011/0214942 A1 * 9/2011 Niemiec ..... E04G 3/00 182/19
2012/0298450 A1 * 11/2012 Sanz ..... A47B 77/04 182/129
2018/0259261 A1 * 9/2018 Kim ..... F26B 9/066

FOREIGN PATENT DOCUMENTS

CN 203106911 8/2013
CN 203106915 8/2013

* cited by examiner

BATHROOM BASE CABINET UNIT HAVING DRYING FUNCTION AND FOOT HOLDING FUNCTION

CROSS-REFERENCE TO RELATED APPLICATION

This application claims priority to and benefit of Korean Patent Application No. 10-2016-0118272, filed Sep. 13, 2016, the subject matter of which is incorporated herein by reference.

BACKGROUND

1. Field

The present disclosure relates to a bathroom base cabinet unit, and more particularly, relates to a bathroom base cabinet unit having a function of drying a bathroom floor, a function of drying a user, and a foot holding function.

2. Background

A bathroom base cabinet may be provided for storage, and may be used as a piece of storage furniture.

A washbasin provided in a bathroom may be mounted on a wall of the bathroom. A bathroom base cabinet may be provided below the washbasin so as to efficiently use a space below the washbasin efficiently.

The washbasin may be integrally formed on an upper plate of the bathroom base cabinet to use the space below the washbasin for storage.

FIG. 1 is a perspective view showing a structure of a bathroom base cabinet. Other arrangements may also be provided.

A bathroom base cabinet 10 may include a washbasin 12 formed on an upper part thereof, a base cabinet body 14 providing a storage space, and supporting legs 16 supporting the base cabinet body 14.

A faucet 13 may be connected to a water supply and a drain pipe. The washbasin 12 may be connected to a sewer pipe. The drain pipe may be connected from a lower part of the washbasin 12 to a floor surface or a wall surface of a bathroom inside the base cabinet body 14. The drain pipe may be provided inside the base cabinet body 14 and may not be exposed to be visible.

A door 15 may be provided at the base cabinet body 14 for opening and closing the storage space.

The supporting legs 16 may serve to space the base cabinet body 14 from the floor surface of the bathroom. Therefore, convenience of cleaning the bathroom floor may be improved, and a bottom surface of the bathroom base cabinet may be protected.

Because an installation height of the washbasin 12 is set based on adults, it is likely that the height of the washbasin 12 may be uncomfortable for use by children.

A separate footstool may be used so that children can efficiently use the washbasin.

Liquid may be on the floor surface because water is always used in the bathroom. The liquid on the floor surface may allow germs to grow. There may be a problem in that contamination and an odor may occur when germs grow. The liquid on the floor surface of the bathroom may make the floor surface slippery, which may cause accidents (for example, falling).

BRIEF DESCRIPTION OF THE DRAWINGS

Arrangements and embodiments may be described in detail with reference to the following drawings in which like reference numerals refer to like elements and wherein.

DETAILED DESCRIPTION

Arrangements and embodiments of a bathroom base cabinet unit having a drying function may be described in detail with reference to the accompanying drawings.

Figure 2:
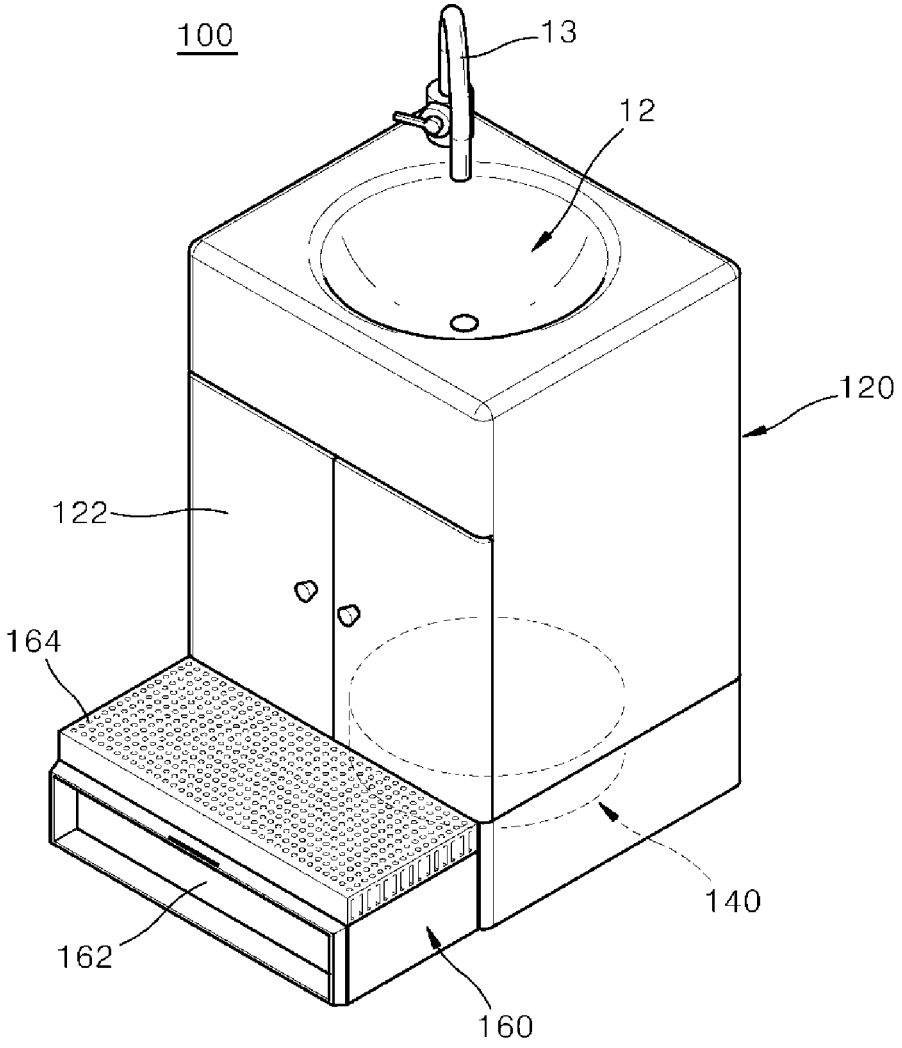
FIG. 2 is a view for describing a configuration of a bathroom base cabinet unit according to an example embodiment.

FIG. 2 is a view illustrating a configuration of a bathroom base cabinet unit according to an example embodiment. Other embodiments and configurations may also be provided.

A bathroom base cabinet unit 100 may include a base cabinet body 120 (or body), a blower 140 (or fan), and a footstool 160. The bathroom base cabinet unit 100 may also be called a bathroom base cabinet, a bathroom base cabinet arrangement, a bathroom base cabinet device or apparatus, etc.

The base cabinet body 120 may have a rectangular box shape. The base cabinet body 120 may be provided below a washbasin 12 (or sink), and an upper surface of the base cabinet body 120 may be integrally coupled to the washbasin 12.

The base cabinet body 120 may include a door 122 for opening and closing a storage space. The base cabinet body 120 may include a withdrawable drawer.

The base cabinet body 120 may be installed inside a bathroom, which may be exposed to humidity and moisture. Therefore, a material forming the base cabinet body 120 may be a material having durability for withstanding damage from humidity and moisture. The base cabinet body 120 may be provided at other areas, at other rooms and/or other structures.

For example, the base cabinet body 120 may be manufactured of a material such as a synthetic resin, a natural stone, an artificial stone, and/or etc. The base cabinet body 120 may also be manufactured of a material such as a natural wood, an artificial wood, etc. A surface of the wood may be coated with an impermeable paint or film to prevent moisture from penetrating into the wood.

A disadvantageous bathroom base cabinet may serve as only a piece of furniture. However, an advantageous bathroom base cabinet, such as the bathroom base cabinet body 120, may serve as a frame to which the footstool 160 and the blower 140 are coupled.

The blower 140 may be provided at a lower part of the base cabinet body 120 and may perform a function of discharging air (or wind). The blower 140 may dry a floor surface of the bathroom by blowing air (or wind) onto the floor surface of the bathroom. The blower 140 may also blow air (or wind) onto an upper surface of the footstool 160 to dry body part such as feet or legs of a user. The blower 140 may also be called a blower device.

A ventilator, mounted on a ceiling or a wall surface of the bathroom, may be a device for air flow in a bathroom environment. However, the ventilator may only serve to discharge moisture or an odor in a bathroom space. As a new air flow device in the bathroom environment, an embodiment may dry a floor surface of the bathroom, dry the body of a user, and/or heat indoor air of the bathroom by the blower 140 being added to the bathroom base cabinet unit 100.

The footstool 160 may be provided in a drawer shape at the lower part (or lower region) of the base cabinet body 120 to be insertable and withdrawable with respect to the cabinet body 120. Insertion and withdrawal operations of the footstool 160 may be manually or electrically performed. A handle may be provided on the footstool 160 to help with the insertion and withdrawal of the footstool 160.

Because the bathroom base cabinet unit 100 does not exhibit a difference in shape from a general bathroom base cabinet, when the footstool 160 is inserted into the base cabinet body 120, a user may not sense a difference.

A position in which the footstool 160 is inserted and withdrawn may relate to a wind blowing direction of the blower 140.

When the footstool 160 is inserted into the base cabinet body 120, wind from the blower 140 may be blown to a front surface outlet 162 provided at a front surface of the footstool 160 such that a floor surface of a bathroom may be dried. The front surface outlet 162 may include a plurality of openings on a surface (such as the front surface). That is, air may be blown through the openings on the front surface.

When the footstool 160 is withdrawn from the base cabinet body 120, air (or wind) from the blower 140 may be blown to an upper surface outlet 164 provided at an upper surface of the footstool 160 such that the body of a user may dry. The upper surface outlet 164 may include a plurality of opening on a surface (such as the upper surface). That is, air may be blown through the opening on the upper surface.

The withdrawn footstool 160 may be used as a footstool for providing a stepping height when a user uses the washbasin 12 or approaches an upper cabinet of the bathroom.

Figure 1:
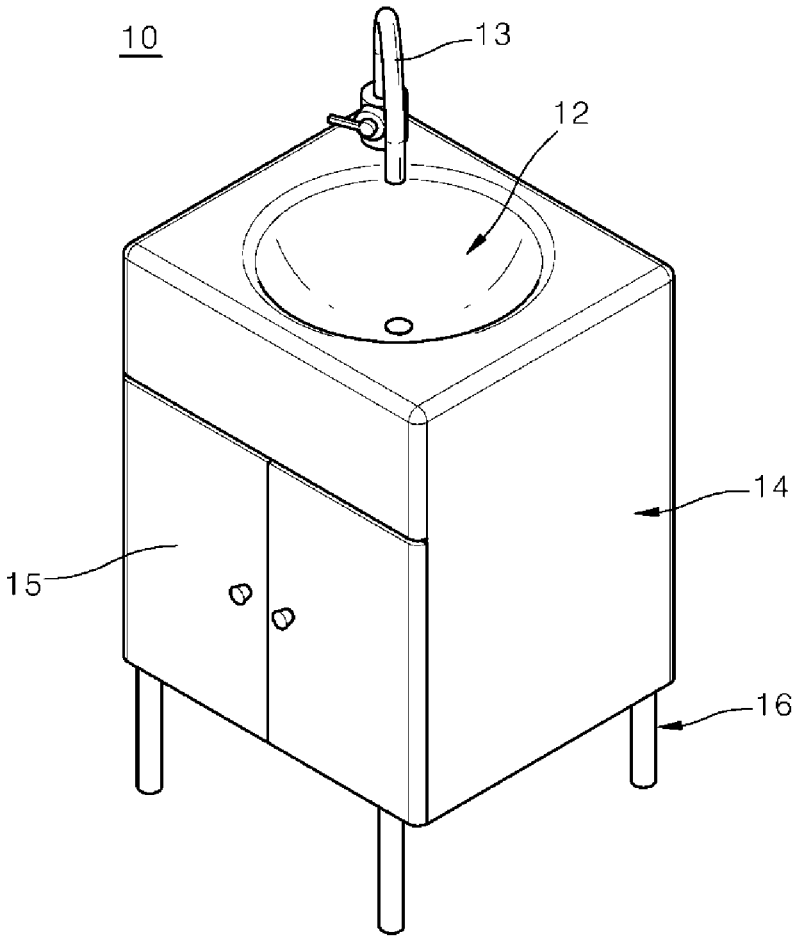
FIG. 1 is a perspective view showing a structure of a bathroom base cabinet.

Because the footstool 160 is provided at the lower part of the base cabinet body 120, storage space of the base cabinet body 120 may be reduced. However, a lower end of the base cabinet body 120 may be used as a part at which supporting legs 16 (FIG. 1) are provided rather than being used as a storage space, and thus there may be less reduction of the storage space.

As described above, the upper surface outlet 164 may be provided at the upper surface of the footstool 160, which may be used as a footstool (of the bathroom base cabinet unit 100). Air or wind from the blower 140 may be blown through the upper surface outlet 164.

The air (or wind) blown through (or to) the upper surface outlet 164 may be used for drying the body of a user standing on the footstool 160. The blower 140 (or blower device) may include a heater or heater device to efficiently dry the body. When the blower 140 includes the heater, the blower 140 may heat air and may provide a heated wind. Therefore, the body of a user or a floor surface of a bathroom may dry using the heated wind provided by the blower 140.

The blower 140 may provide the heated air (or wind) to adjust an indoor temperature of the bathroom.

The blower 140 may be provided at the lower part of the base cabinet body 120, and may be withdrawn with the footstool 160 as shown, but is not limited thereto. The blower 140 may be fixed (or attached) at the base cabinet body 120 such that the blower 140 is not withdrawn from the cabinet body 120 with the footstool 160, and the blower 140 may maintain a fixed position of the blower even when the footstool 160 is withdrawn.

Various embodiments of a bathroom base cabinet unit (or bathroom base cabinet) may now be described. Other embodiments and configurations may also be provided.

Figure 3:
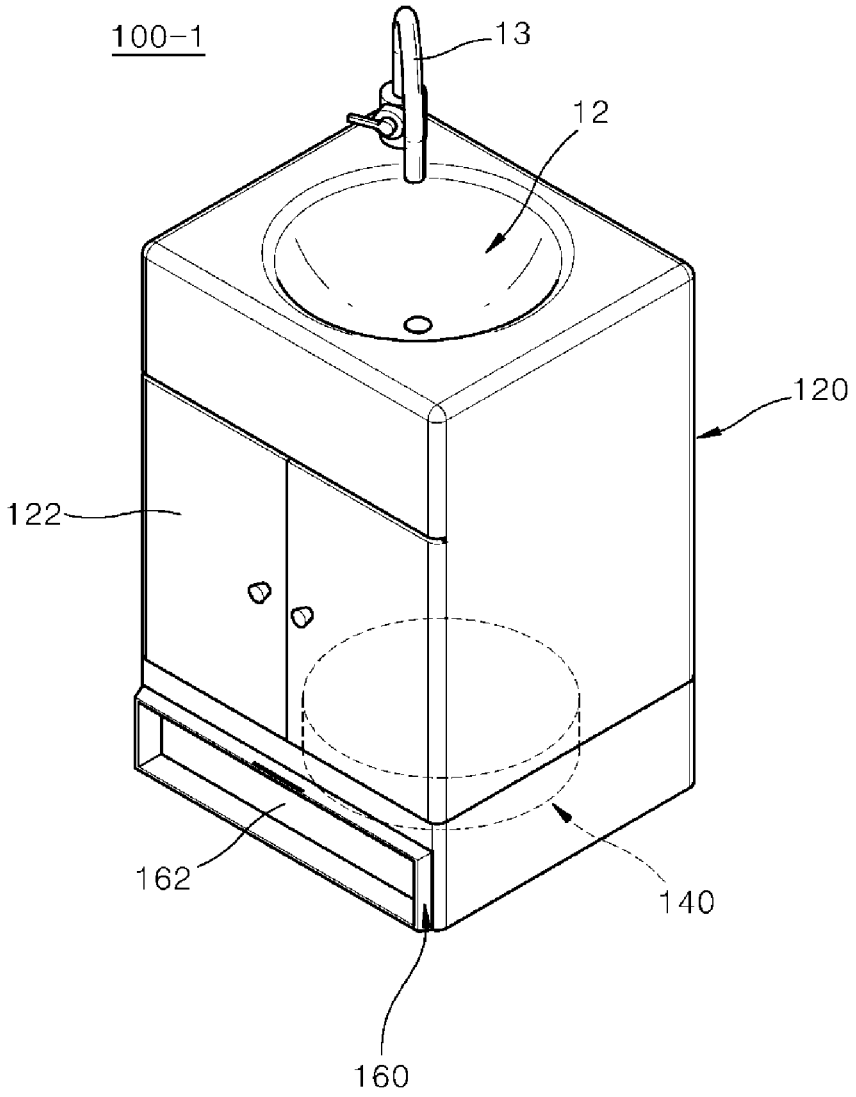
FIG. 3 is a view showing a bathroom base cabinet unit according to a first embodiment when a footstool is inserted into a base cabinet body.
Figure 4:
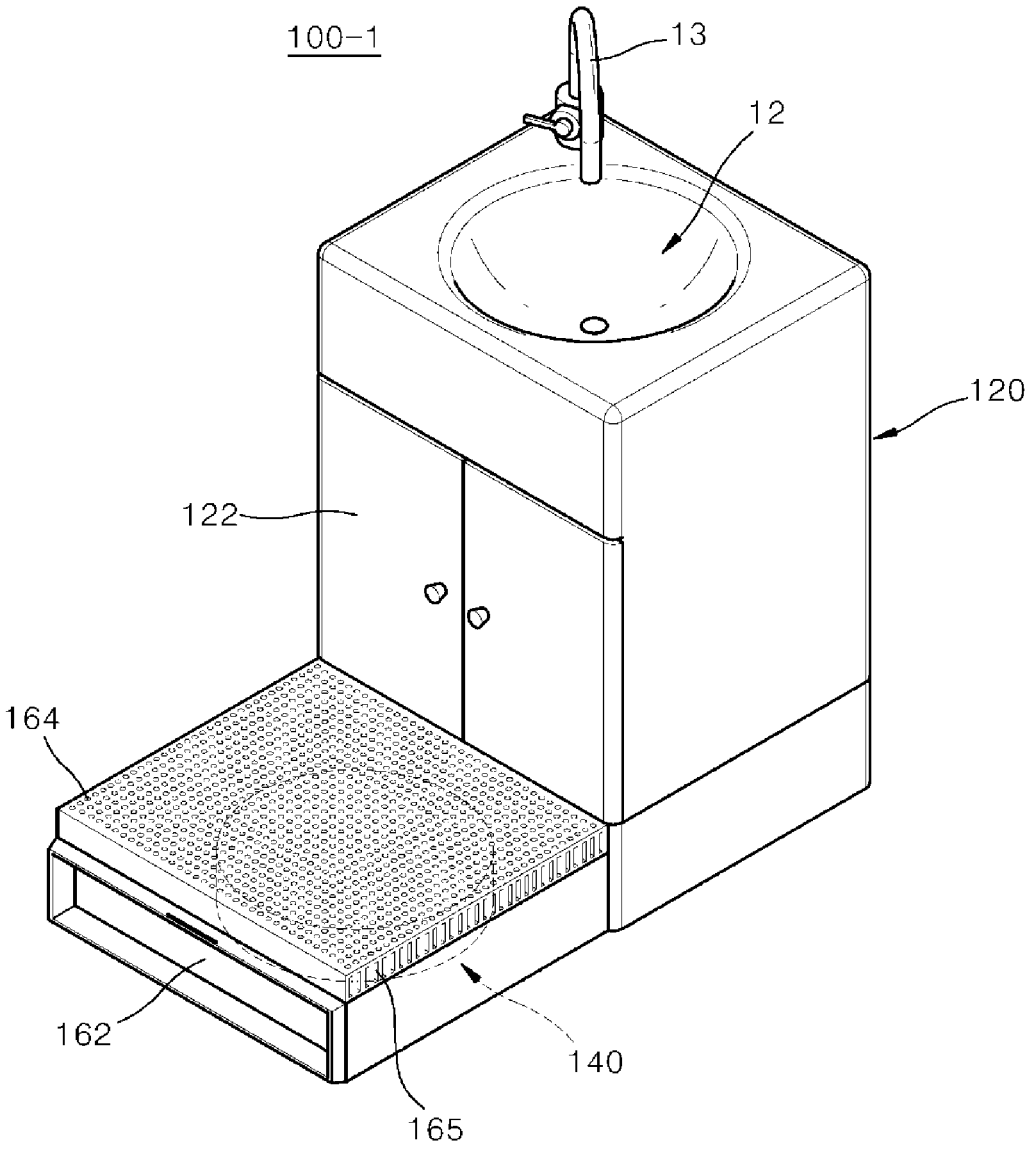
FIG. 4 is a view showing the bathroom base cabinet unit according to the first embodiment when the footstool is withdrawn from the base cabinet body.

FIGS. 3 and 4 are views showing a bathroom base cabinet unit according to a first embodiment. FIG. 3 illustrates an embodiment in which a footstool is inserted into a base cabinet body. FIG. 4 illustrates an embodiment in which the footstool is withdrawn from the base cabinet body. Other embodiments and configurations may also be provided.

A bathroom base cabinet unit 100-1 according to the first embodiment may include a base cabinet body 120 (or body), a footstool 160, and a blower 140 (or fan). The footstool 160 may be provided at a lower part of the base cabinet body 120 to be insertable and withdrawable. The blower 140 (or blower device) may be provided inside the footstool 160 to move with the footstool 160. The bathroom base cabinet unit 100-1 may also be called a bathroom base cabinet or a bathroom base cabinet arrangement.

The footstool 160 may be inserted into the base cabinet body 120 as shown in FIG. 3. The footstool 160 (or portions of the footstool) may be withdrawn from the base cabinet body 120 as shown in FIG. 4.

A front surface outlet 162 may be provided at a front surface of the footstool 160, and an upper surface outlet 164 may be provided at an upper surface of the footstool 160. An inlet 165 may be provided at a side of the footstool 160.

The front surface outlet 162 may be provided such that air (or wind) discharged from the blower 140 may be guided to a floor surface of a bathroom.

When the blower 140 is operating while the footstool 160 is inserted into the cabinet body 120, air (or wind) blowing from the blower may be discharged to the front surface outlet 162 such that the floor surface of the bathroom is dried.

Because the bathroom is a space in which water and soap may be used, the floor surface of the bathroom may be left with residual water or may easily enter into a humid state, and water or humidity on the floor surface of the bathroom may allow the growth of germs, occurrence of an odor, and/or accidents due to slippage.

Because a washbasin 12 is provided on an upper part of the bathroom base cabinet unit 100-1, water splashed while using the washbasin 12 may often remain on the bathroom floor.

The bathroom base cabinet unit 100-1 according to the first embodiment may quickly dry moisture on the floor surface of the bathroom by blowing air (or wind) from the blower 140 through the front surface outlet 162 (located on the front surface of the footstool 160) and onto the floor space of the bathroom.

The bathroom base cabinet unit 100-1 may include the upper surface outlet 164 on the upper surface of the footstool 160. The upper surface outlet 164 may not be exposed to the outside when the footstool 160 is inserted into the base cabinet body 120. The upper surface outlet 164 may be exposed to the outside when the footstool 160 is withdrawn from the base cabinet body 120 as shown in FIG. 4.

The upper surface of the footstool 160 may be a supporting surface on which a user steps and stands. Therefore, when the upper surface outlet 164 is provided at the upper surface of the footstool 160 to blow the air (or wind) from the blower 140 through the upper surface outlet 164, the air (or wind) may blow through the upper surface of the footstool 160 or the body of the user standing on the upper part of the footstool 160.

For example, when the user puts his or her foot on the withdrawn footstool 160 and stands thereon after washing his or her foot or taking a shower and operates the blower 140, which blows wind to the upper surface outlet 164, the wind blowing from the upper surface outlet 164 may dry body parts of the user.

Figure 5:
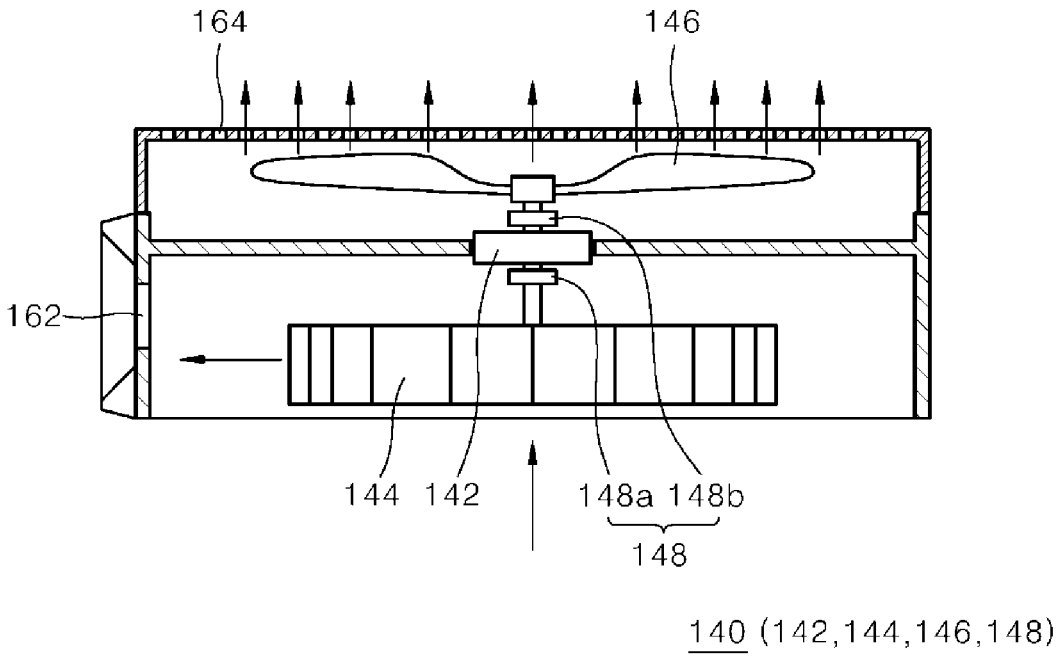
FIG. 5 is a cross-sectional view showing a configuration of a blower included in the bathroom base cabinet unit according to the first embodiment.

FIG. 5 is a view showing a configuration of a blower of the bathroom base cabinet unit according to the first embodiment. Other embodiments and configurations may also be provided.

As described above, the blower 140 may blow wind to the front surface outlet 162 provided at the front surface of the footstool 160 or blow wind to the upper surface outlet 164 provided at the upper surface of the footstool 160.

As shown in the figure, the blower 140 (or blower device) may include a driving motor 142, a front surface blower fan 144, an upper surface blower fan 146, and a power switching device 148 (or power switching unit).

The driving motor 142 may include a biaxial motor having a structure in which both rotating shafts are vertically arranged.

The upper surface blower fan 146, for blowing wind to the upper surface outlet 164, may be connected to an upper shaft of the driving motor 142. The front surface blower fan 144, for blowing wind to the front surface outlet 162, may be connected to a lower shaft of the driving motor 142.

An axial flow fan that suctions air from the inlet 165 (FIG. 4) may be provided at the side of the footstool 160 and may blow the air to the upper surface outlet 164 in an upper direction, and may be the upper surface blower fan 146.

A centrifugal fan that suctions air from a lower surface and blows the air to the front surface outlet 162 in a front surface direction may be the front surface blower fan 144. The front surface blower fan 144 may be provided directly above the floor surface of the bathroom. When the centrifugal fan is operated, a flow of air, which is suctioned into the centrifugal fan, may flow onto the floor surface of the bathroom such that the floor surface of the bathroom under the centrifugal fan is also dried.

When the upper surface blower fan 146 and the front surface blower fan 144 are simultaneously operated, an unnecessary overload may be delivered to the driving motor. Further, both the upper surface outlet 164 and the inlet 165 (FIG. 4) may be blocked when the footstool 160 is inserted into the base cabinet body 120. Therefore, when the upper surface blower fan 146 is operated when the footstool 160 is inserted into the base cabinet body 120, blowing effects may not be realized and an unnecessary load and noise may occur.

The blower 140 may include the power switching device 148 such that the upper surface blower fan 146 or the front surface blower fan 144 may be selectively driven using a single driving motor, namely the driving motor 142.

The power switching device 148 may include a first one-way clutch **148*a* and a second one-way clutch 148*b*. The first one-way clutch 148*a* may connect a lower shaft of the driving motor 142 and the front surface blower fan 144. The second one-way clutch 148*b* may connect an upper shaft of the driving motor 142 and the upper surface blower fan 146**.

The one-way clutch may deliver a rotatory driving force when rotated in a forward direction, and may block the delivery of the rotatory driving force when rotated in a reverse direction. Conversely, the one-way clutch may deliver the rotatory driving force when rotated in the reverse direction, and may block the rotatory driving force when rotated in the forward direction.

When the driving motor 142 is driven in the forward direction, the rotatory driving force may be delivered through a first one-way clutch bearing 281 while not being delivered through a second one-way clutch bearing 282.

In an example in which the driving motor 142 is driven in the forward direction, the front surface blower fan 144 may rotate while the upper surface blower fan 146 is not rotated. Conversely, in the example in which the driving motor 142 is driven in the reverse direction, the front surface blower fan 144 may not rotate and only the upper surface blower fan 146 may rotate.

A configuration for selectively driving the upper surface blower fan 146 and the front surface blower fan 144 using the single driving motor 142 may use a method other than using the one-way clutch bearing. For example, a clutch for connecting the driving motor 142 and the upper surface blower fan 146 and a clutch for connecting the driving motor and the front surface blower fan 144 may be provided such that the driving force is delivered to the upper surface blower fan 146 or the front surface blower fan 144 by selectively opening and closing the clutches.

In a configuration including the blower 140, two driving motors may be provided to drive the upper surface blower fan 146 and the front surface blower fan 144. However, there may be little necessity to drive the upper surface blower fan 146 and the front surface blower fan 144 at the same time, and/or it may be enough to selectively drive only one blower fan.

Figure 6:
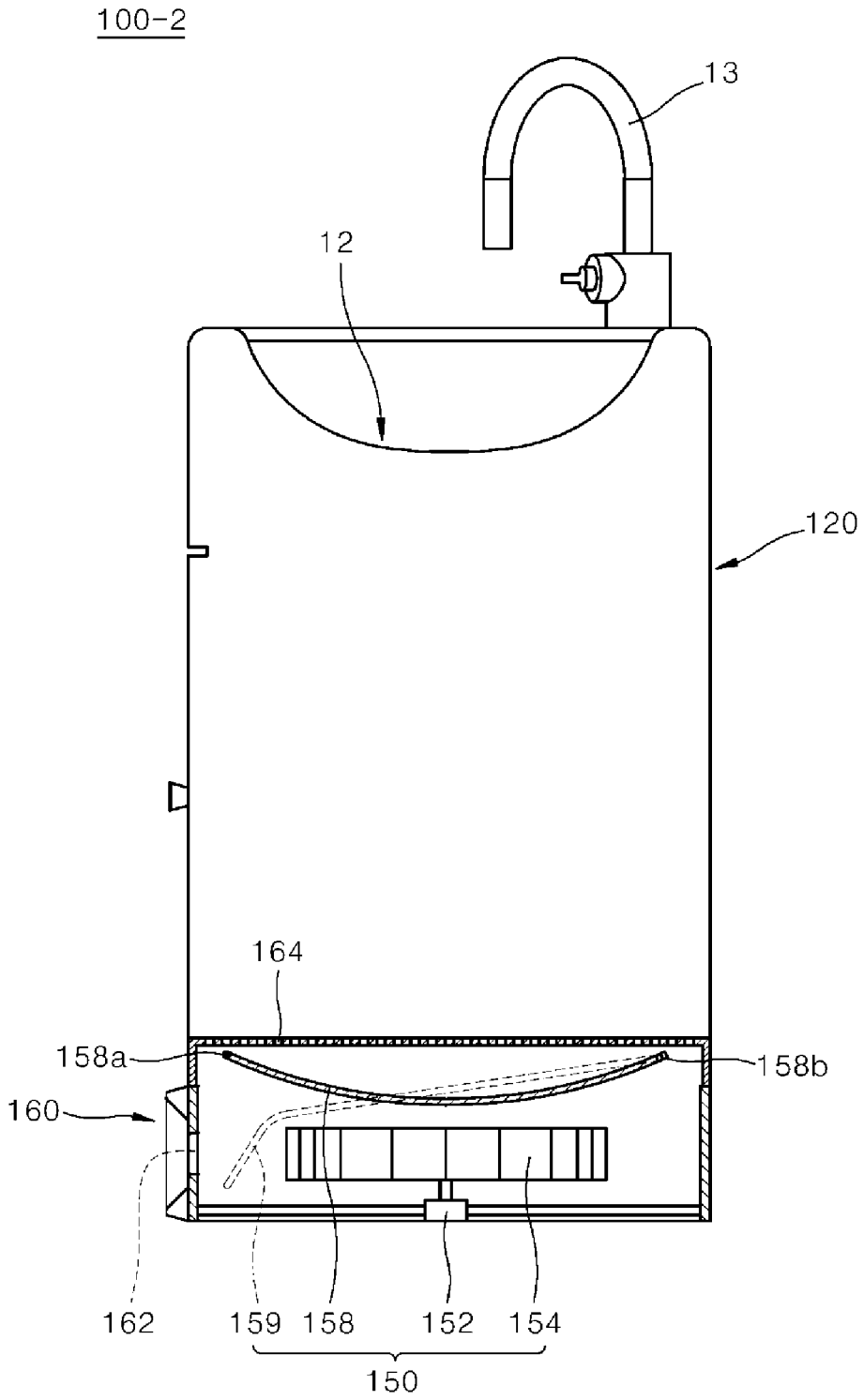
FIG. 6 is a view showing a bathroom base cabinet unit according to a second embodiment when a footstool is inserted into a base cabinet body.
Figure 7:
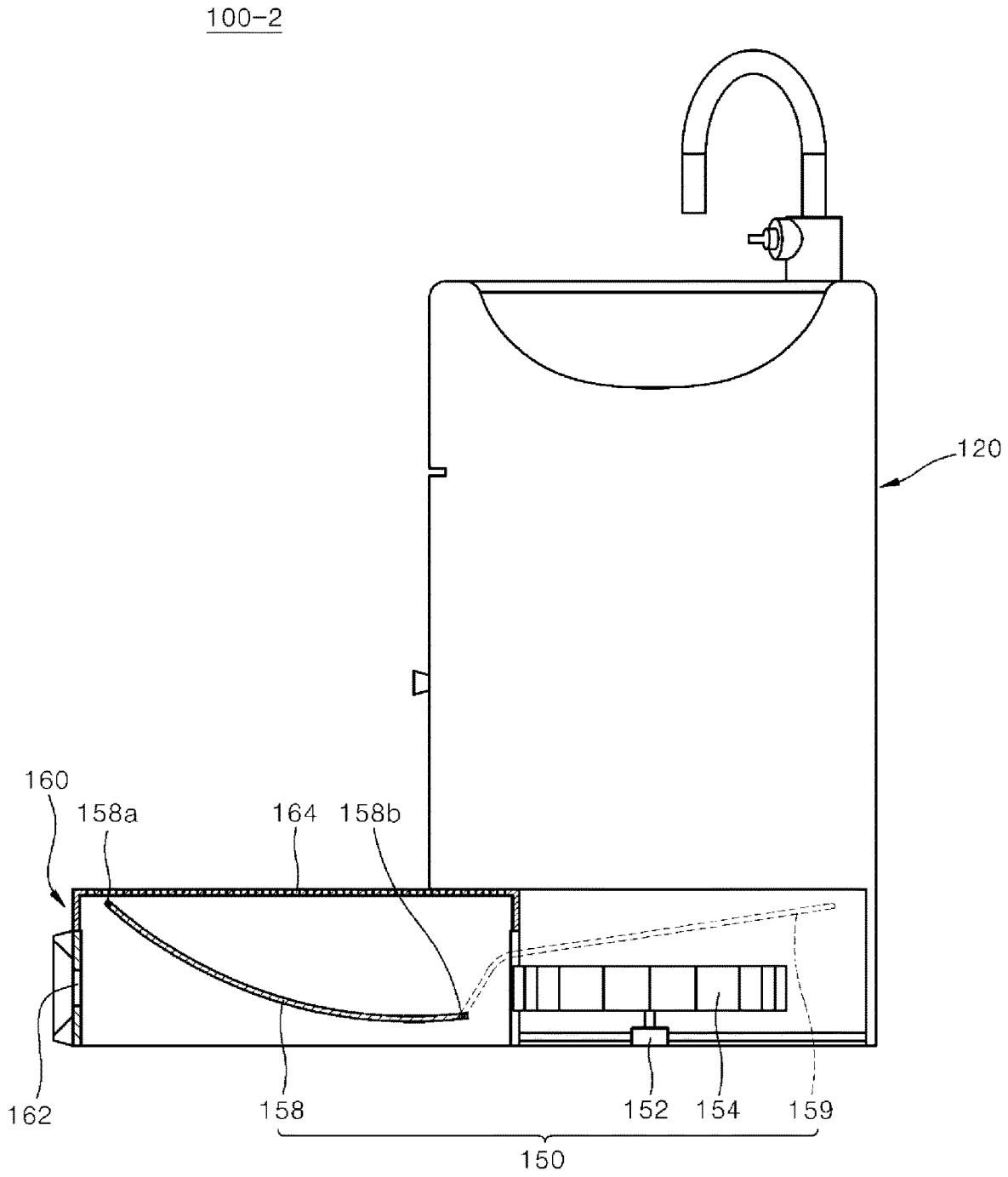
FIG. 7 is a view showing the bathroom base cabinet unit according to the second embodiment when the footstool is withdrawn from the base cabinet body.

FIGS. 6 and 7 are views showing a bathroom base cabinet unit according to a second embodiment. FIG. 6 illustrates an embodiment in which a footstool is inserted into a base cabinet body. FIG. 7 illustrates an embodiment in which the footstool is withdrawn from the base cabinet body. Other embodiments and configurations may also be provided.

A bathroom base cabinet unit 100-2 according to the second embodiment may include a base cabinet body 120, a blower 150 (or fan) fixed to the base cabinet body 120, and a footstool 160 provided at the base cabinet body 120 to be insertable and withdrawable.

The bathroom base cabinet unit 100-1 according to the first embodiment may have a configuration in which the blower 140 is fixed to the footstool 160 such that the blower 140 is inserted and withdrawn with the footstool 160. In a second embodiment, the bathroom base cabinet unit 100-2 may include the blower 150 fixed to the base cabinet body 120, and the blower 150 may maintain being fixed at a predetermined position at the lower part of the base cabinet body 120 regardless of the insertion and withdrawal of the footstool 160.

When the blower 150 is fixed (or attached) to the base cabinet body 120, a weight of the footstool 160 may be lightened such that a force or load used for the insertion and withdrawal operations may be reduced.

The blower 150 of the bathroom base cabinet unit 100-2 may include a single driving motor 152 and a single blower fan 154.

The blower fan 154 may be a centrifugal blower fan for suctioning air from the lower part and sending the air to one side. This may be the same as the front surface blower fan (of the first embodiment).

The blower 150 may be fixed (or attached) at a bottom surface of the base cabinet body 120. The blower fan 154 connected to the blower 150 may blow wind in a direction of the front surface of the footstool 160.

A position of a flow path guide 158 may vary in conjunction with the insertion and withdrawal of the footstool 160.

When the footstool 160 is inserted into the base cabinet body 120 as shown in FIG. 6, the flow path guide 158 may be located above of the blower fan 154. When the driving motor 152 operates such that the blower fan 154 rotates, air (or wind) may be blown through the front surface outlet 162.

When the footstool 160 is withdrawn from the base cabinet body 120 as shown in FIG. 7, the flow path guide 158 may be located in a diagonal direction with respect to the front surface of the blower fan 154. Therefore, when the driving motor 152 is operating to rotate the blower fan 154, the flow path guide 158 switches a direction of the wind to a side of the upper surface while the wind is blown toward a side of the front surface, and then the wind is blown to the upper surface outlet 164.

The flow path guide 158 may operate in conjunction with the insertion and withdrawal operations of the footstool 160. A first side of the flow path guide 158 may be pivotably fixed to the footstool 160 based on a hinge shaft 158*a*, and a protrusion 158*b* may be provided on a second side of the flow path guide 156. The protrusion 158*b* may be moved by riding on a guide groove 159 provided inside the base cabinet body 120.

Accordingly, when the footstool 160 is withdrawn, the flow path guide 158 (attached to the footstool 160 by the hinge shaft 158*a*) may be withdrawn from the base cabinet body 120 while being led by the footstool 160. The second side of the flow path guide 158 may rotate toward a lower side while being moved by riding on the guide groove 159 via the protrusion 158*b*.

Conversely, when the footstool 160 is inserted into the base cabinet body 120, the flow path guide 158 may rotate in a direction in which the flow path guide 158 is lifted and is then inserted into the base cabinet body 120.

Figure 8:
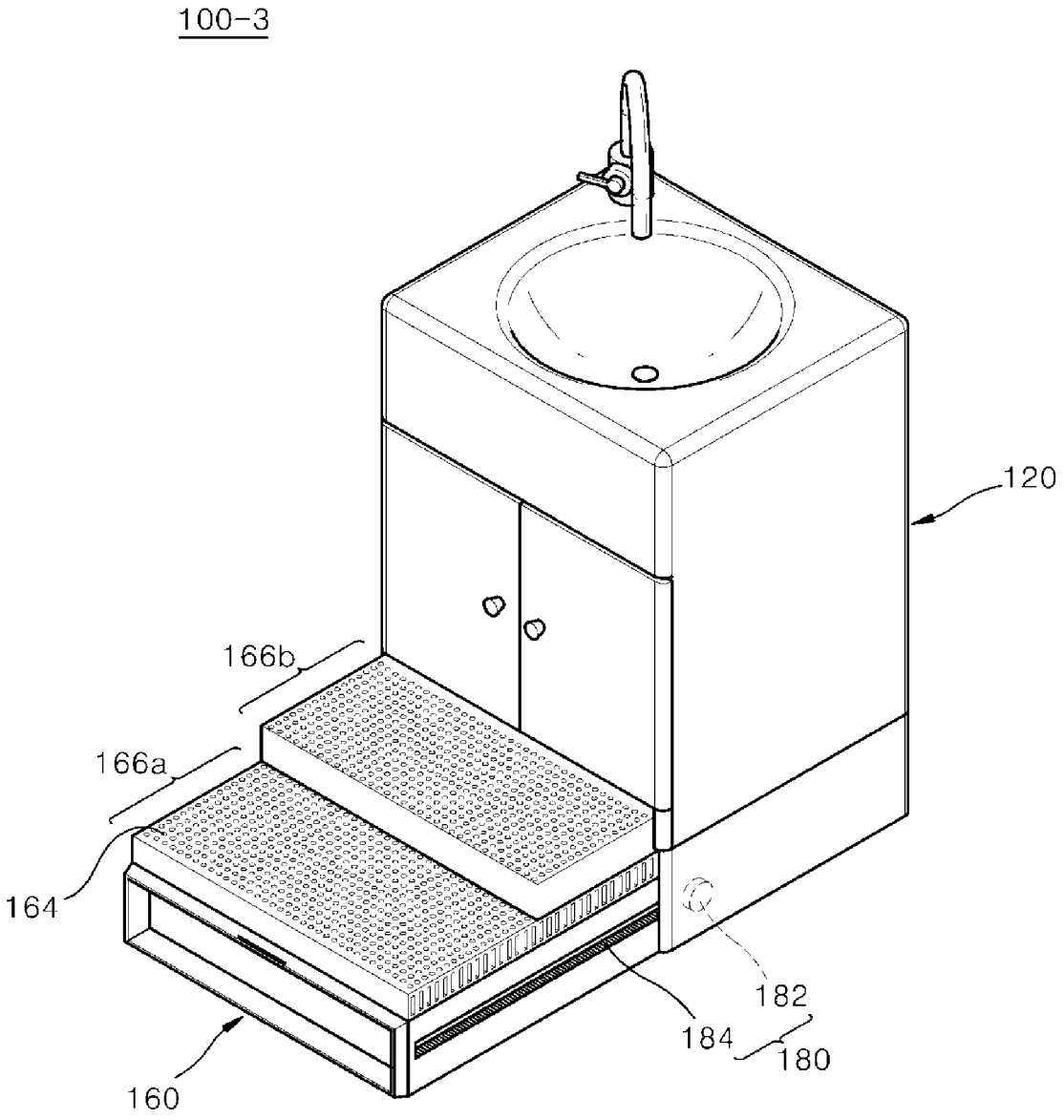
FIG. 8 is a view showing a bathroom base cabinet unit according to a third embodiment when a footstool is completely withdrawn from a base cabinet body.
Figure 9:
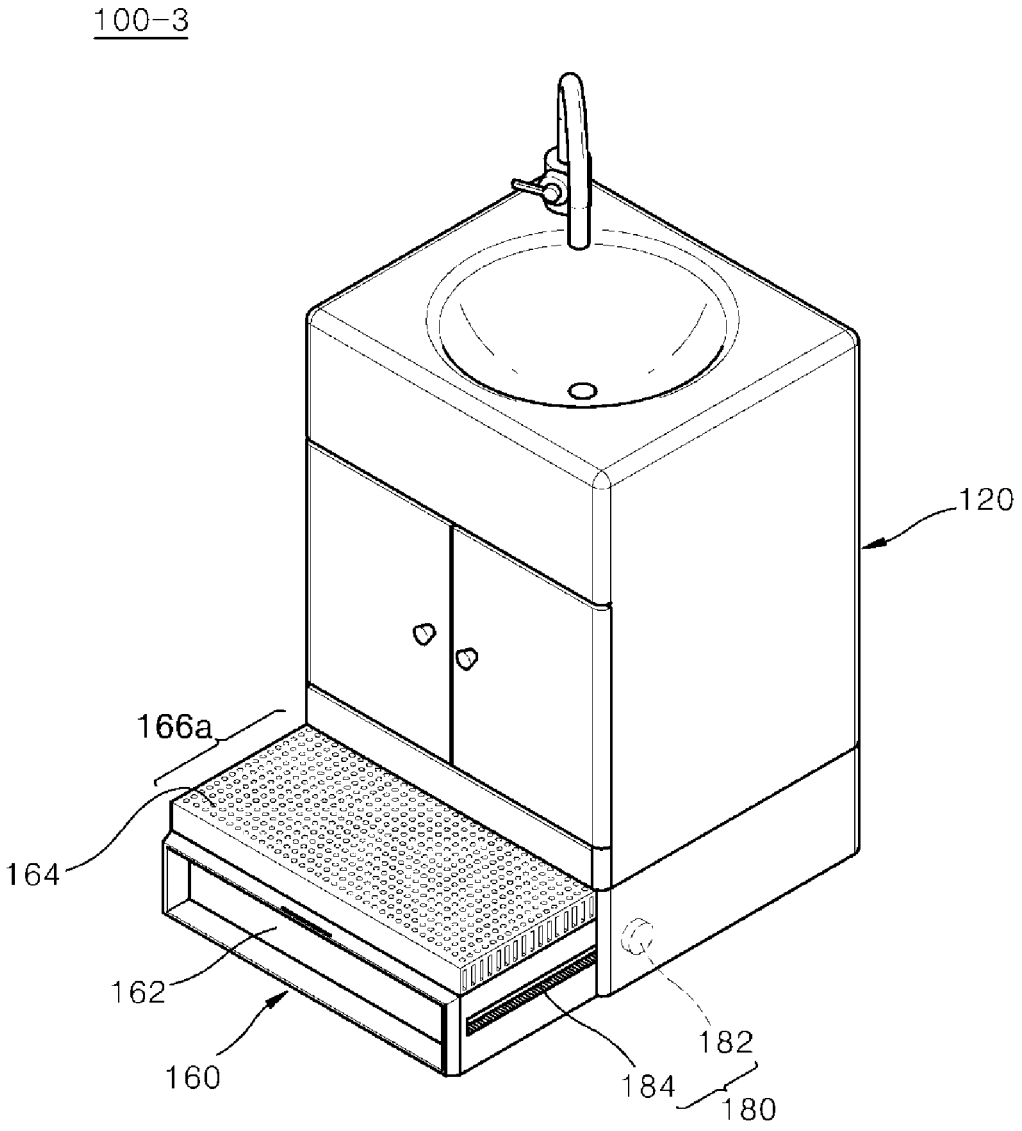
FIG. 9 is a view showing the bathroom base cabinet unit according to the third embodiment when the footstool is partially withdrawn from the base cabinet body.

FIGS. 8 and 9 are views illustrating a bathroom base cabinet unit according to a third embodiment. FIG. 8 shows an embodiment in which a footstool is completely withdrawn from a base cabinet body. FIG. 9 shows an embodiment in which the footstool is partially withdrawn from the base cabinet body. Other embodiments and configurations may also be provided.

A bathroom base cabinet unit 100-3 may include a base cabinet body 120, a footstool 160 (or fan), a blower (or blower device), and an insertion and withdrawal driving device 180 for electrically performing the insertion and withdrawal operation of the footstool 160. The insertion and withdrawal driving device 180 may also be called an insertion and withdrawal driving unit, for example.

The insertion and withdrawal driving device 180 may include a driving motor 182, a pinion gear connected to the driving motor 182, and a rack gear 184 provided at the footstool 160 and that meshes with the pinion gear. When the pinion gear is rotated by a driving force of the driving motor 182, the rack gear 184 meshed with the pinion gear is moved forward and backward. As a result, the footstool 160 may be moved forward and backward by the rack gear 184 being moved forward and backward, and may perform the insertion and withdrawal operations.

The footstool 160 according to the third embodiment may be characterized in that an upper surface of the footstool 160 is provided in a stair shape having a step. When the upper surface of the footstool 160 is provided in the stair shape having a step to provide a stepping height, the stepping height may be selected by a user adjusting a withdrawal degree of the footstool 160.

Referring to FIG. 8, the footstool 160 may include a first upper surface 166*a* having a relatively low height and a second upper surface 166*b* having a relatively high height. As shown in FIG. 8, when the footstool 160 is completely withdrawn, the user may step and stand on the second upper surface 166*b*. As shown in FIG. 9, when the footstool 160 is withdrawn such that only the first upper surface 166*a* is exposed, the user may step and stand on the first upper surface 166*a*.

The stair shape configuration of the upper surface of the footstool 160 may improve convenience in which a toddler or a child uses a washbasin.

The blower illustrated in the first embodiment or the blower illustrated in the second embodiment may be applied to the third embodiment.

Figure 10:
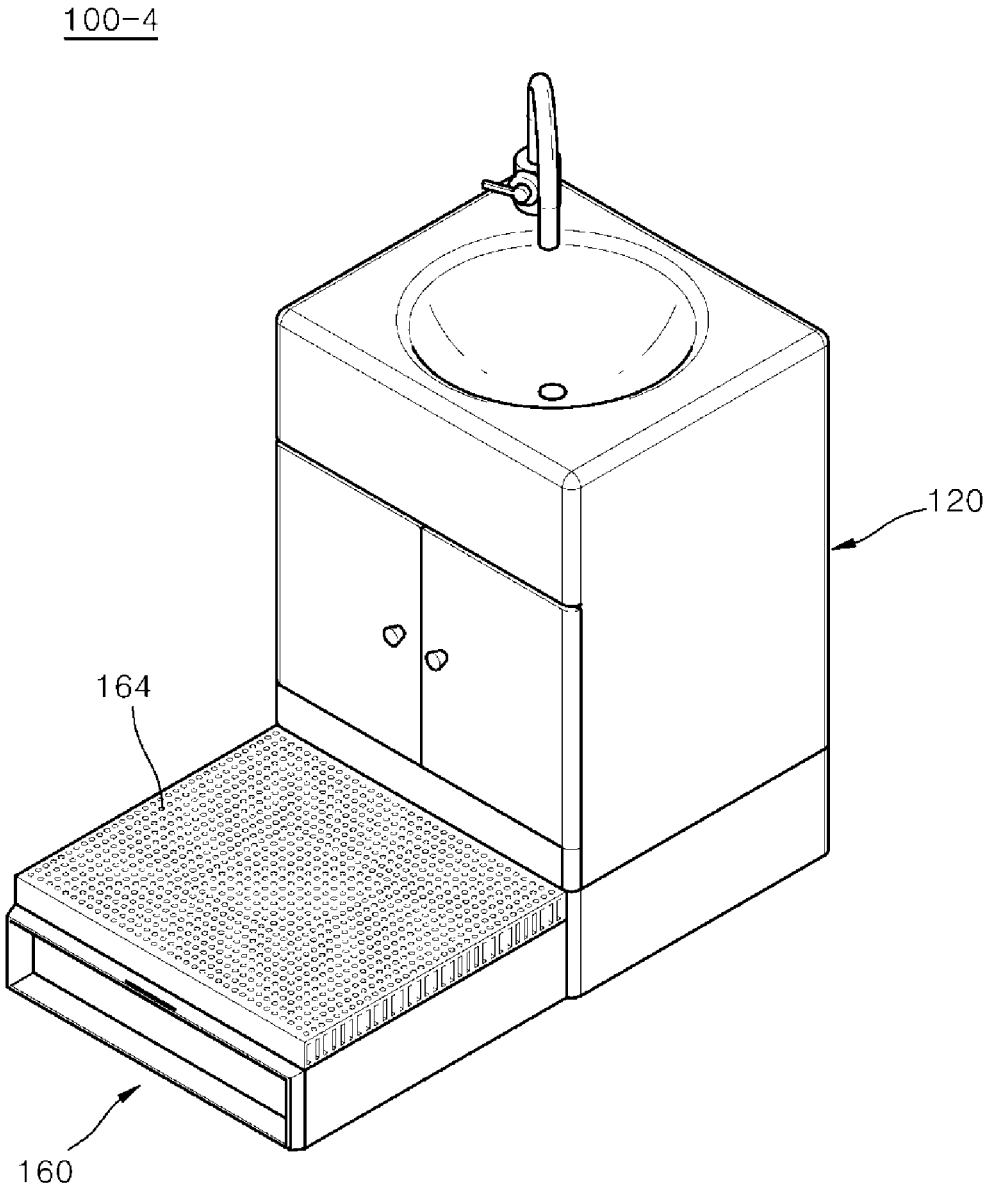
FIG. 10 is a view showing a bathroom base cabinet unit according to a fourth embodiment when only a footstool is withdrawn from a base cabinet body.
Figure 11:
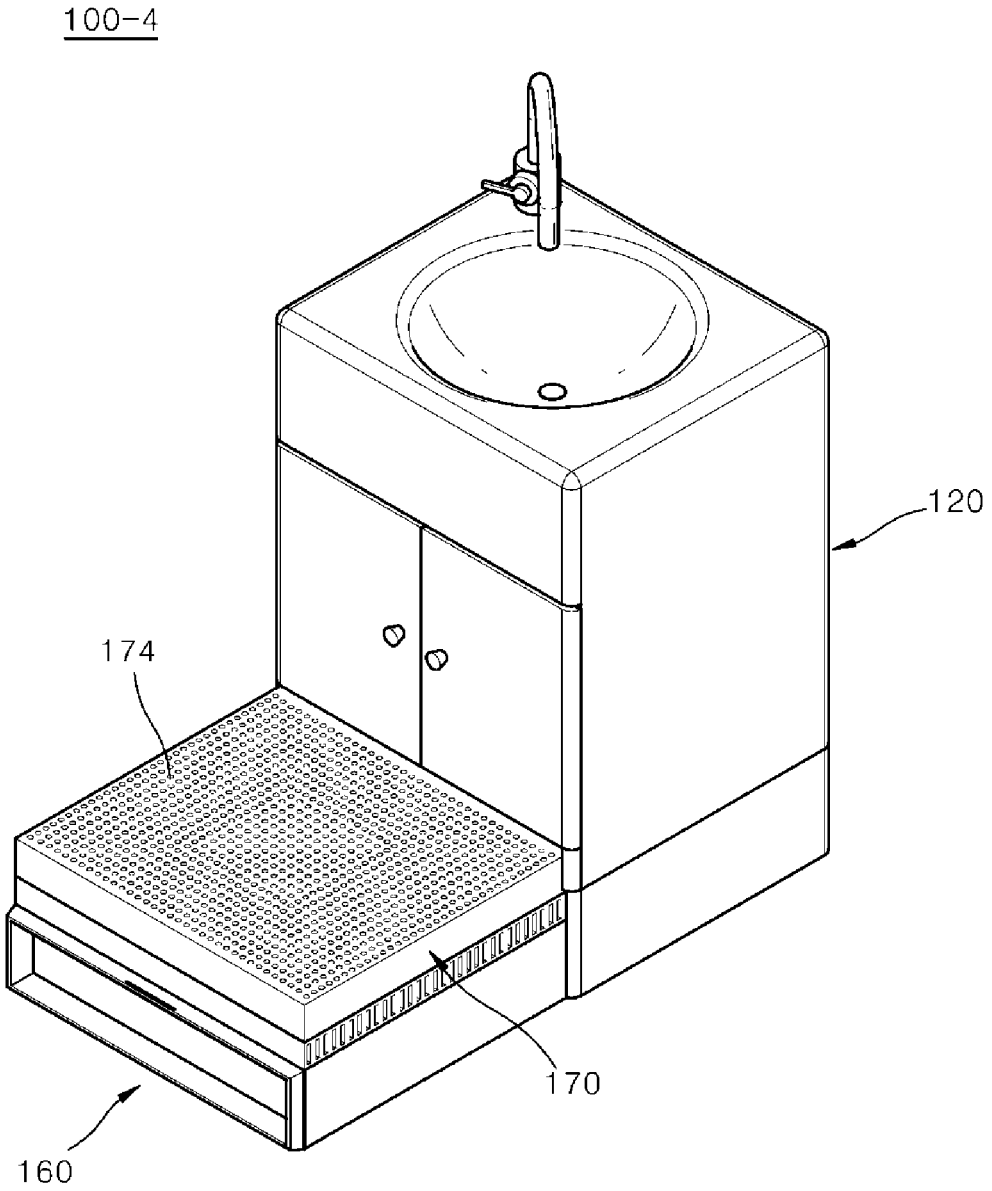
FIG. 11 is a view showing the bathroom base cabinet unit according to the fourth embodiment when the footstool and an auxiliary top plate are both withdrawn from the base cabinet body.

FIGS. 10 and 11 are views showing a bathroom base cabinet unit according to a fourth embodiment. FIG. 10 shows an embodiment in which only a footstool is withdrawn from a base cabinet body. FIG. 11 shows an embodiment in which the footstool and an auxiliary top plate are withdrawn from the base cabinet body. Other embodiments and configurations may also be provided.

A bathroom base cabinet unit 100-4 according to the fourth embodiment may include a base cabinet body 120, a blower (or blower device), a footstool 160, and an auxiliary top plate 170.

A step on the upper surface of the footstool may be made in the bathroom base cabinet unit 100-3 so that the stepping height thereof may be adjusted. However, the bathroom base cabinet unit 100-4 may include the auxiliary top plate 170, which is independently withdrawable. The auxiliary top plate 170 may be provided on an upper part of the footstool 160 such that a stepping height may be selected by a user.

The auxiliary top plate 170 may include an auxiliary top plate outlet 174 on an upper surface thereof. The auxiliary top plate outlet 174 may be provided such that air (or wind) blown through the upper surface outlet 164 of the footstool 160 passes through the auxiliary top plate 170 and is blown to the upper surface of the auxiliary top plate 170.

The bathroom base cabinet unit 100-4 may be used by withdrawing the footstool 160 only as shown in FIG. 10, or the bathroom base cabinet unit 100-4 may be used by withdrawing the footstool 160 and the auxiliary top plate 170 as shown in FIG. 11. A relatively low height may be provided when withdrawing and using the footstool 160 only. A relatively high height may be provided when withdrawing and using the footstool 160 and the auxiliary top plate 170.

The bathroom base cabinet unit 100-4 may include one auxiliary top plate 170 such that two types of stepping height may be provided. When a plurality of auxiliary top plates are provided in a multi-layered shape, a larger variety of stepping heights may be provided.

Embodiments may include a blower providing a function of drying a bathroom floor or the body of a user in a bathroom base cabinet, thereby a bathroom space can be maintained in a more pleasant condition and user convenience can be improved.

A bathroom base cabinet unit may provide a structure capable of discharging air blown by a blower from an upper surface of a footstool so that body parts of a user, such as the user's foot, on the footstool is dried so that user convenience can be improved.

A function capable of drying a bathroom floor can inhibit the growth of germs inside the bathroom due to residual moisture on the bathroom floor and reduce the occurrence of user accidents due to liquid being on a slippery floor surface.

A bathroom base cabinet unit may provide an insertable and withdrawable footstool at a lower part of the bathroom base cabinet such that short users or children can withdraw the footstool to step and stand thereon to use a washbasin.

A user can simply apply the bathroom base cabinet unit to a limited bathroom space without an additional installation of several devices. Therefore, the user may efficiently use the bathroom space.

It is an object to provide a bathroom base cabinet unit capable of providing a function for drying a floor surface of a bathroom or the body of a user along with basic functions for storing bathroom products.

It is another object to provide a bathroom base cabinet unit capable of blowing wind onto a floor surface of a bathroom or onto the body of a user using a single driving motor.

It is still another object to provide a bathroom base cabinet unit capable of providing a footstool to be withdrawn so that a user steps and stands on the footstool as necessary when using a washbasin or an upper cabinet.

According to an object, there is provided a bathroom base cabinet unit including a base cabinet body forming an appearance thereof and providing a storage space, a footstool provided at the base cabinet body to be insertable and withdrawable, and a blower for blowing wind to a front surface or an upper surface of the footstool while being fixed at the base cabinet body or the footstool. The bathroom base cabinet unit may provide a function of drying a floor surface of a bathroom when the footstool is inserted into the base cabinet body, and a function of drying the body of a user when the footstool is withdrawn from the base cabinet body.

The blower may include a driving motor, an upper surface blower fan connected to the driving motor, a front surface blower fan, and a power switching unit (or device) for controlling delivery of a driving force to the upper surface blower fan or the front surface blower fan, and may selectively operate the upper surface blower fan or the front surface blower fan using a single driving motor.

The bathroom base cabinet unit may include an upper surface of the footstool formed in a stair shape so that the footstool may provide one of various stepping heights, or an auxiliary top plate configured to be withdrawn from the base cabinet body separately from the footstool.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A bathroom base cabinet comprising:

a base cabinet body to provide a supporting structure;

a footstool to be insertable into a lower part of the base cabinet body, and the footstool to be withdrawable from the lower part of the base cabinet body; and a blower device attached to the footstool to move air with respect to the footstool, wherein the footstool includes a front surface outlet and an upper surface outlet, wherein the front surface outlet is provided at a front surface of the footstool, and the upper surface outlet is provided at an upper surface of the footstool, wherein when the footstool is inserted into the base cabinet body, the upper surface of the footstool is not exposed to outside of the base cabinet body and air is to be blown through the front surface outlet; and when the footstool is at least partially withdrawn from the base cabinet body, the upper surface of the footstool is exposed to outside of the cabinet body and air is to be blown through the upper surface outlet.

2. The bathroom base cabinet of claim 1, wherein the blower device includes:

a driving motor to provide power;

a front surface blower fan coupled to the driving motor and configured to blow air through the front surface outlet;

an upper surface blower fan coupled to the driving motor and configured to blow air through the upper surface outlet; and a power switching device configured to selectively deliver the power to the front surface blower fan or the upper surface blower fan.

3. The bathroom base cabinet of claim 2, wherein:

the driving motor is to rotate in a forward direction or a reverse direction; and the power switching device includes a first one-way clutch bearing configured to control the power to be delivered to the front surface blower fan and a second one-way clutch bearing configured to control the power to be delivered to the upper surface blower fan.

4. The bathroom base cabinet of claim 1, further comprising an insertion and withdrawal driving device configured to control the footstool to insert the footstool into the base cabinet body and to control the footstool to withdraw the footstool from the base cabinet body.

5. The bathroom base cabinet of claim 1, wherein the upper surface of the footstool is provided in a stair shape having a step.

6. The bathroom base cabinet of claim 1, further comprising an auxiliary top plate to be insertable into the base cabinet body and to be withdrawable from the base cabinet body, wherein the auxiliary top plate to be provided on the footstool when the auxiliary top plate is withdrawn from the cabinet body.

7. The bathroom base cabinet of claim 1, comprising a washbasin provided on an upper part of the base cabinet body.

8. The bathroom base cabinet of claim 1, wherein the blower device includes a heater configured to heat air.

9. A base cabinet comprising:

a base cabinet body having a storage area, wherein the base cabinet body includes a door to open and close the storage area;

a blower device at the base cabinet body; and a footstool configured to be insertable into a lower part of the base cabinet body, and to be withdrawable from the lower part of the base cabinet body, wherein the footstool includes a front surface outlet and an upper surface outlet, wherein the front surface outlet is provided at a front surface of the footstool, and the upper surface outlet is provided at an upper surface of the footstool, wherein when the footstool is inserted into the base cabinet body, the upper surface of the footstool is not exposed to outside of the base cabinet body and air is to be blown through the front surface outlet; and when the footstool is at least partially withdrawn from the base cabinet body, the upper surface of the footstool is exposed to outside of the base cabinet body and air is to be blown through the upper surface outlet.

10. The base cabinet of claim 9, wherein the footstool includes:

a flow path guide configured to selectively guide air from the blower device to the front surface outlet or the upper surface outlet.

11. The base cabinet of claim 10, wherein the flow path guide guides the air to the upper surface outlet when the footstool is at least partially withdrawn from the base cabinet body.

12. The base cabinet of claim 9, further comprising an insertion and withdrawal driving device configured to control the footstool to insert the footstool into the base cabinet body and to control the footstool to withdraw the footstool from the base cabinet body.

13. The base cabinet of claim 9, wherein the upper surface of the footstool is provided in a stair shape having a step.

14. The base cabinet of claim 9, further comprising an auxiliary top plate to be insertable into the base cabinet body and to be withdrawable from the base cabinet body, wherein the auxiliary top plate to be provided on the footstool when the auxiliary top plate is withdrawn from the base cabinet body.

15. The base cabinet of claim 9, comprising a washbasin provided at an upper part of the base cabinet body.

16. The base cabinet of claim 9, wherein the blower device includes a heater configured to heat air.

17. A bathroom base cabinet comprising:

a base cabinet body to provide a storage area, the cabinet body having a door to open and close the storage area;

a washbasin provided on the base cabinet body;

a blower device to move air; and a footstool to move between a first position and a second position, the footstool including first openings at a first surface and second openings at a second surface, wherein the first position is the footstool provided under the base cabinet body, and the second position is the first and second openings being at least partially exposed to outside of the base cabinet body, wherein when the footstool is inserted into the base cabinet body, the second surface of the footstool is not exposed to outside of the base cabinet body and air is to be blown through the first openings; and when the footstool is at least partially withdrawn from the base cabinet body, the second surface of the footstool is exposed to outside of the base cabinet body and air is to be blown through the second openings.

18. The bathroom base cabinet of claim 17, wherein the blower device is coupled to the footstool to move with respect to the base cabinet body.

19. The bathroom base cabinet of claim 17, comprising a driving device to move the footstool with respect to the base cabinet body.

* * * * *